United States Patent [19]

Kurtz

[11] 4,181,587

[45] Jan. 1, 1980

[54] PROCESS FOR PRODUCING CHLORINE AND CAUSTIC SODA

[75] Inventor: Bruce E. Kurtz, Marcellus, N.Y.

[73] Assignee: Allied Chemical Corporation, Morristown, N.J.

[21] Appl. No.: 967,190

[22] Filed: Dec. 7, 1978

[51] Int. Cl.[2] ..... C25B 1/16; C25B 1/26

[52] U.S. Cl. ..... 204/98; 204/128

[58] Field of Search ..... 204/98, 128

[56] References Cited

U.S. PATENT DOCUMENTS 4,057,474 11/1977 Kurtz et al. ..... 204/257

*Primary Examiner*—R. L. Andrews

*Attorney, Agent, or Firm*—Michael S. Jarosz; Anthony J. Stewart

[57] ABSTRACT

A process for producing chlorine and caustic soda is described involving a bank of electrolytic membrane cells arranged for series catholyte flow. Power efficiency is improved by maintaining at least two of the initial cells in the bank in parallel catholyte flow, combining the catholyte streams from such initial cells and introducing the combined catholyte into the cathode compartment of one or more succeeding cells in the bank.

1 Claim, 3 Drawing Figures

CURRENT EFFICIENCY VS CAUSTIC SODA CONCENTRATION IN THE CATHOLYTE

VOLTAGE EFFICIENCY VS CAUSTIC SODA CONCENTRATION IN THE CATHOLYTE

POWER EFFICIENCY VS CAUSTIC SODA CONCENTRATION IN THE CATHOLYTE

PROCESS FOR PRODUCING CHLORINE AND CAUSTIC SODA

BACKGROUND OF THE INVENTION

This invention relates to the electrolytic production of chlorine and caustic soda (sodium hydroxide). More particularly, this invention relates to the production of chlorine and caustic soda in electrolytic membrane cells.

U.S. Pat. No. 4,057,474, which is expressly incorporated herein by reference, describes a process for electrolyzing sodium chloride brine in membrane cells in which current efficiency is improved. This improvement is accomplished by operating a bank of a plurality of cells and causing the catholyte to pass from the cathode compartment of a first cell to the cathode compartment of one or more succeeding cells in the bank, i.e., by operating in series catholyte flow.

A principal economic factor for processes which produce chlorine and caustic soda is electric energy. Attempts are constantly being made to improve the efficiency of the use of this energy.

Accordingly it is an object of this invention to provide an improved process for the electrolytic production of chlorine and caustic soda. It is a further object of this invention to provide an improved process for the production of chlorine and caustic soda employing electrolytic membrane cells adapted for series catholyte flow.

These and other objects will become apparent from the description which follows.

SUMMARY OF THE INVENTION

In accordance with this invention there is provided an improved process for producing chlorine and caustic soda by the electrolysis of an aqueous sodium chloride solution in a bank of a plurality of electrolytic cells, each cell having a cathode compartment and an anode compartment separated by a cationic permeable membrane and wherein catholyte flows in series from the cathode compartment of a cell to the cathode compartment of one or more succeeding cells in the bank. The improvement comprises introducing water into the cathode compartment of at least two of the initial cells in the bank, withdrawing catholyte from each said initial cells, combining the catholyte streams so withdrawn and introducing said combined catholyte stream into the cathode compartment of one or more succeeding cells in the bank.

By operating at least two of the initial cells in parallel catholyte flow the overall power efficiency of the bank of cells is improved, resulting in a decrease in the amount of energy consumed.

DETAILED DESCRIPTION OF THE INVENTION

This invention provides an improvement in the basic process of employing series catholyte flow in a multicompartment bipolar permselective membrane electrolyzer, or a group of monopolar permselective membrane cells, for the production of chlorine and caustic soda (sodium hydroxide), which involves an arrangement or configuration of individual cells in a series catholyte flow assembly so as to maximize the overall power efficiency of the assembly.

In the production of chlorine and caustic soda by electrolysis of sodium chloride brine in permselective membrane cells, current efficiency typically decreases monotonically with increasing caustic soda concentrations.

Figure 1:
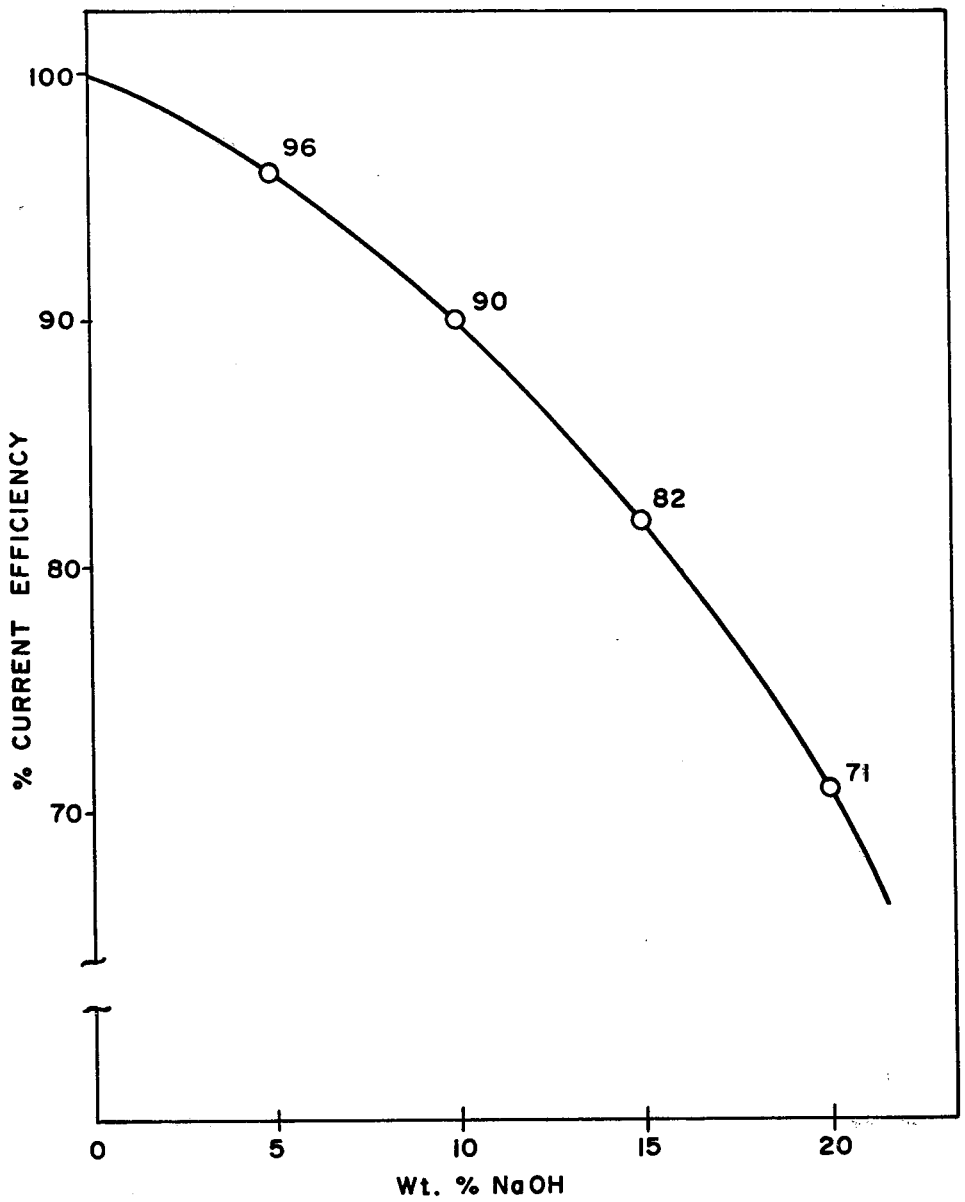
FIGS. 1 to 3 are graphs illustrating the relationship between caustic soda concentration in the catholyte of an electrolytic membrane cell and current efficiency (FIG. 1), voltage efficiency (FIG. 2) and power efficiency (FIG. 3). All of these graphs are based on data from cells employing, as the membrane, perfluoro-sulfonic acid membranes sold under the trademark NAFION.
Figure 2:
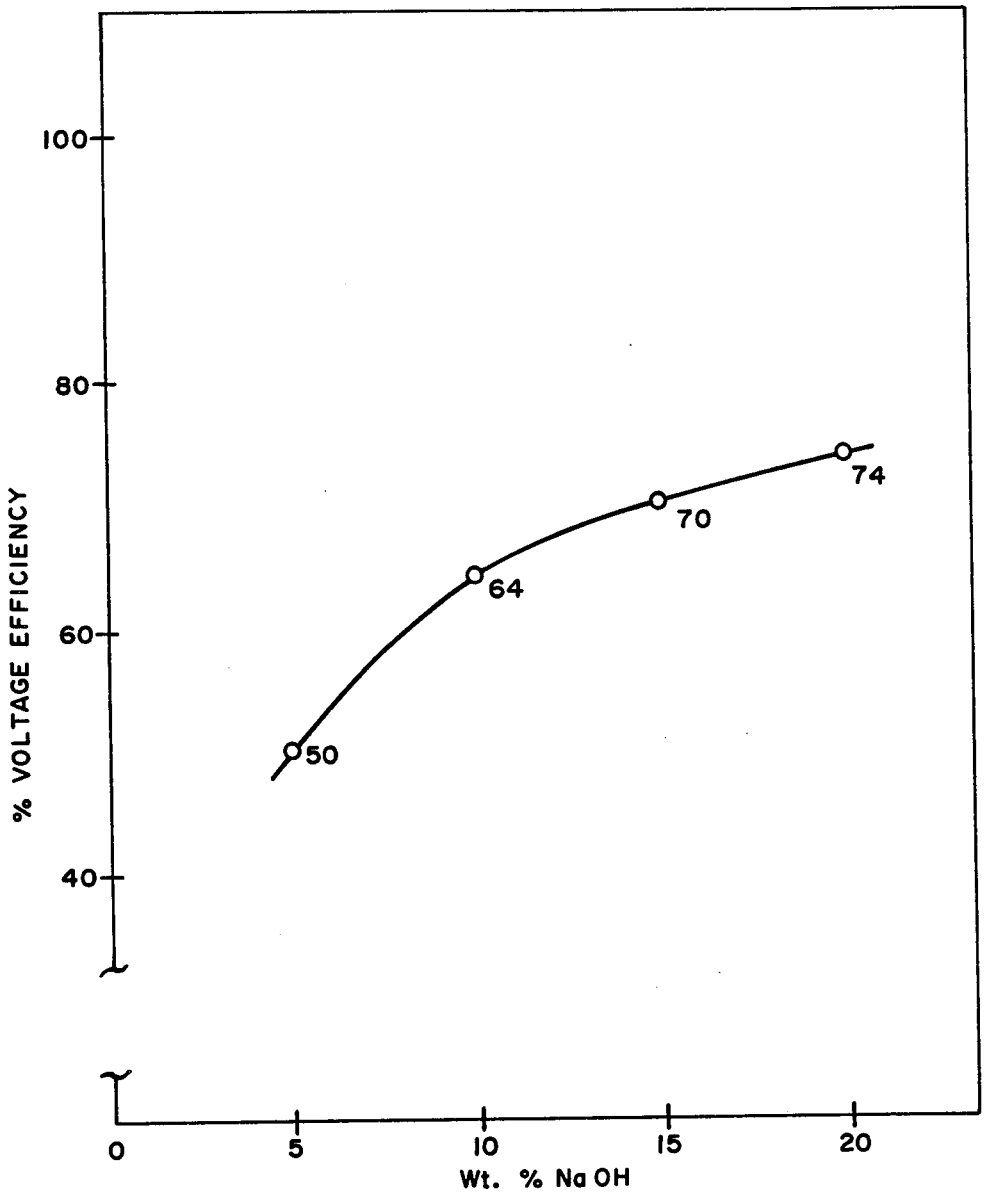
Figure 3:
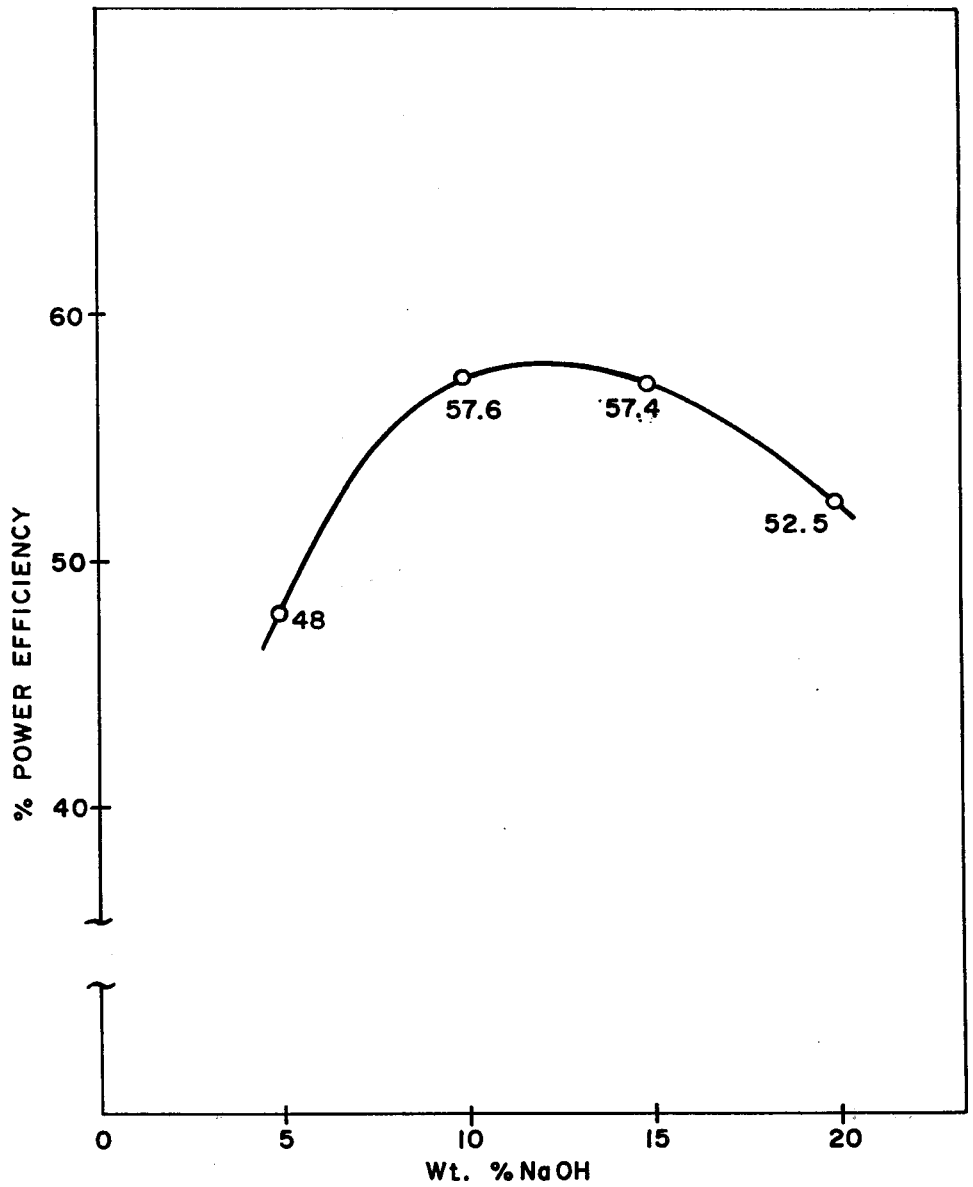

In the drawings, FIG. 1 represents a typical curve of current efficiency versus caustic soda concentration in the catholyte of a permselective membrane electrolytic cell and illustrates the decrease in current efficiency as the caustic soda concentration increases. FIG. 2 depicts the increase in voltage efficiency which accompanies the increase in caustic soda concentration. The product of the voltage efficiency and the current efficiency is the power efficiency and, as shown in FIG. 3, the power efficiency curve typically goes through a maximum valve as the concentration of the caustic soda increases.

In the case of decreasing current efficiency, this is due to increasing back-migration of hydroxyl ion through the membrane; in the case of increasing voltage efficiency, this effect is a result of increasing electrical conductivity of the catholyte.

Current and voltage efficiencies in production of chlorine/caustic soda by electrolysis are defined, and the factors influencing them described, in U.S. Pat. No. 4,057,474.

It can be seen that, with current efficiency decreasing monotonically with increasing caustic soda concentration, a simple series catholyte flow arrangement will always lead to a higher current efficiency than a parallel catholyte flow arrangement for the same final concentration of caustic soda in the catholyte. A "simple" series catholyte flow arrangement is defined as one in which single cells, each operating at the same current load, are connected together such that the catholyte from each single cell flows to the cathode compartment of a succeeding cell.

It has now been found that a modified series catholyte flow arrangement in which, for example, the first two cells in an assembly are in parallel catholyte flow, the catholyte exit streams are combined and fed together into a third cell in series catholyte flow with a fourth and a fifth cell, will result in an improvement in power efficiency despite the fact that such is disadvantageous in terms of current efficiency as compared to simple series catholyte flow.

The current efficiency for each individual cell depends on the caustic soda concentration within the cell, as shown in FIG. 1, while the overall current efficiency for the assembly is the average of the individual cell current efficiencies, assuming the current passing through each to be equal. Thus, the larger the number of cells in a simple series catholyte flow assembly, the closer will the overall current efficiency approach the maximum attainable value which is the average obtained by integrating under the curve of FIG. 1 from zero to the final concentration of caustic soda in the catholyte. This value will be attained precisely for an infinite number of cells in simple series catholyte flow.

For any finite number of cells the maximum overall current efficiency for a given number of cells and a constant final caustic soda concentration in the catholyte will be attained for simple series catholyte flow, as this will maximize the number of finite change-in-concentration steps under the curve of current efficiency.

The situation is quite different, however, if it is desired to maximize power efficiency, which exhibits a maximum as a function of caustic soda concentration in the catholyte, as shown by FIG. 3. It has now been found that it is advantageous to arrange individual cells such that none operate in the regime of caustic soda concentration substantially to the left of the maximum in the curve of power efficiency versus caustic soda concentration.

In accordance with this invention this is accomplished by a modified series catholyte flow arrangement in which the first two or more cells in an assembly are operated in parallel catholyte flow and subsequent cells are operated in series catholyte flow, as described earlier. Operating the first two or more cells in parallel catholyte flow assures that a higher caustic soda concentration is attained in each of those cells than would be the case if they were operated in series catholyte flow. The exact configuration to maximize power efficiency obviously will vary depending on the shape of the power efficiency curve. However, whatever the shape of the power efficiency curve, a sufficient number of initial cells will be operated in parallel catholyte flow to provide a concentration of caustic soda in their combined catholyte streams which is not substantially to the left of the maximum in such curve.

In order to provide maximum power efficiency it is desirable to rigorously calculate the performance of each individual cell in a bank. This requires consideration of the composition of the entering and exiting catholyte streams, transport of materials through the membrane, and water lost as vapor along with the evolved hydrogen.

Thus, in calculating individual cell performance, x = Mols $OH^-$ formed in the cathode compartment by electrolysis of $H_2O$.

x' = Mols $OH^-$ lost from the cathode compartment by back-migration through the membrane.

x'' = Mols NaOH fed to the cathode compartment from a preceding cell.

y = Mols $H_2O$ entering the cathode compartment by endosmotic flow through the membrane.

y' = Mols $H_2O$ lost from the cathode compartment as vapor with the evolved hydrogen.

y'' = Mols $H_2O$ fed to the cathode compartment from a preceding cell or, for the first cell, from an external source.

Note also that:

$$y = k(x - x')$$

$$y' = k'x$$

where k is a constant representing the mols of endosmotic $H_2O$ per mol of $Na^+$ transported through the membrane and k' is a constant representing the mols of $H_2O$ per $\frac{1}{2}$ mol of $H_2$ formed. k' is a function of the $H_2O$ vapor pressure and thus depends on catholyte temperature and NaOH concentration.

For a series catholyte flow arrangement a particular cell is designated by the subscript n, while the cell immediately preceding is designated by n−1. Thus, for any one cell:

$$x''_n = x''_{n-1} + x_{n-1} - x'_{n-1}$$

$$y''_n = y''_{n-1} + y_{n-1} - y'_{n-1}$$

With the preceding definitions an expression for the concentration of NaOH (wieght %) in the catholyte exiting any cell is:

$$C_n = \frac{(x''_n + x_n - x'_n)(40)(100)}{(x''_n + x_n - x'_n)(40) + (y''_n + y_n - y'_n)(18)} \quad (1)$$

Substituting $$y_n = k_n(x_n - x'_n) \quad (2)$$

and $$y'_n = k'_n x_n \quad (3)$$

$$C_n = \frac{(x''_n + x_n - x'_n)(40)(100)}{(x''_n + x_n - x'_n)(40) + (y''_n + k_n[x_n - x'_n] - k'_n x_n)(18)} \quad (4)$$

The NaOH current efficiency is defined as:

$$E_n = \frac{x_n - x'_n}{x_n}(100) \quad (5)$$

or $$(x_n - x'_n) = \frac{E_n x_n}{100} \quad (6)$$

Substituting Equation 6 into Equation 4, $$C_n = \frac{4000\, x''_n + 40\, E_n x_n}{40\, x''_n + 18\, y''_n + x_n(0.4\, E_n + 0.18\, k_n E_n - 18\, k'_n)} \quad (7)$$

Equation 7 relates NaOH concentration in the catholyte to NaOH current efficiency ($E_n$), $H_2O$ electrolyzed ($x_n$), NaOH and $H_2O$ fed to the cathode compartment ($x''_n$ and $y''_n$), and the two constants ($k_n$ and $k'_n$) for endosmotic water and water vapor lost with the hydrogen. This equation can be used to calculate the performance of a series catholyte flow assembly of any specified arrangement and the arrangement giving the maximum power efficiency can be found.

Description of Preferred Embodiments

A computer program was developed for the implicit solution of Equation 7 given a specific series catholyte flow arrangement and caustic soda concentration in the catholyte of the final cell (product concentration). This program was used to develop the following examples.

For these examples the constant k representing endosmotic water was assumed equal to 3.5 mols $H_2O$/mol $Na^+$ transported through the membrane. This is consistent with experience with the membranes for which the performance curves of FIGS. 1-3 are typical.

The constant $k'_n$ representing water lost as vapor with the hydrogen was calculated from the vapor pressure of $H_2O$ over a NaOH solution at 80° C. and varying concentration using data from the 4th Edition of Perry's "Chemical Engineer's Handbook," Section 3-67. These data were converted to mol fraction $H_2O$ ($u_n$) in the hydrogen stream as a function of $C_n$ and the following tabulation of $k'_n$ values was obtained from the relationship $$k'_n = \frac{1}{2} \frac{u_n}{1 - u_n} \quad (8)$$

| $C_n$ | $u_n$ | $k'_n$ |
|---|---|---|
| 0 | 0.460 | 0.426 |
| 5 | 0.448 | 0.406 |
| 10 | 0.422 | 0.365 |
| 15 | 0.388 | 0.317 |
| 20 | 0.346 | 0.264 |

An equation relating $k'_n$ to $C_n$ was fitted and incorporated into the computer program.

The curves of current efficiency and power efficiency against $C_n$ (FIGS. 1 and 3) were also fitted and incorporated into the computer program.

The computational procedure was iterative, involving an initial assumption of $C_n$ for the first cell, determination of $E_n$, $k_n$ and $k'_n$ from the incorporated equations, and calculation of a value of $C_n$. The procedure was repeated until the assumed and calculated values were in satisfactory agreement. The value of $C_n$ for the first cell then becomes $C_{n-1}$ for feed to the second cell and the iterative procedure was repeated, and so on until the last cell in the assembly was reached. If the final value of $C_n$ was not in satisfactory agreement with the desired value, a new value for the first cell was assumed and the entire procedure was repeated.

Various series catholyte flow arrangements were evaluated with the program.

Cells which are in parallel catholyte flow are designated by the assignment of the same integer cell configuration number. Those which are in series are designated by successively higher integer cell configuration numbers. Thus, a 5-cell assembly with the first two cells in parallel and subsequent cells in series would be designated as:

| Cell # | Cell Configuration Number |
|---|---|
| 1 | 1 |
| 2 | 1 |
| 3 | 2 |
| 4 | 3 |
| 5 | 4 |

It is understood in all cases that the current passing through each cell, and thus the amount of $OH^-$ formed by electrolysis, is the same.

The following tabulation shows the results obtained for a variety of series catholyte flow arrangements, ranked according to overall power efficiency attained, all for a final concentration of 20 weight % NaOH in the catholyte:

| Configuration | Overall Power Efficiency |
|---|---|
| 11111 | 52.7% |
| 12345 | 55.3 |
| 11223 | 55.8 |
| 11123 | 55.9 |
| 11112222334 | 56.0 |
| 111222334 | 56.0 |

-continued

| Configuration | Overall Power Efficiency |
|---|---|
| 11234 | 56.2 |

From these results it is evident that, while simple series catholyte flow (12345) is superior to parallel catholyte flow (11111), modified series catholyte flow, in which cells located at the feed end of the assembly are configured in parallel flow while cells located nearer the product end of the assembly are configured in series flow, is better still. The best of the various 5-cell configurations is 11234, in which the first two cells are in parallel flow and the subsequent three in series flow.

The optimal configuration for any given cell system will have a number of cells at the beginning of the stack in parallel flow such that the NaOH concentration attained approximates that giving the maximum power efficiency, with subsequent cells in the assembly in series flow.

The following tabulation illustrates this:

| Cell # | Cell Configuration | NaOH Concentration | Power Efficiency |
|---|---|---|---|
| 1 | 1 | 19.9 | 52.7 |
| 2 | 1 | 19.9 | 52.7 |
| 3 | 1 | 19.9 | 52.7 |
| 4 | 1 | 19.9 | 52.7 |
| 5 | 1 | 19.9 | 52.7 |
| | | | Avg. = 52.7 |
| 1 | 1 | 7.3 | 54.1 |
| 2 | 2 | 12.1 | 58.4 |
| 3 | 3 | 15.6 | 57.0 |
| 4 | 4 | 18.1 | 54.7 |
| 5 | 5 | 20.1 | 52.5 |
| | | | Avg. = 55.3 |
| 1 | 1 | 11.9 | 58.4 |
| 2 | 1 | 11.9 | 58.4 |
| 3 | 2 | 15.3 | 57.1 |
| 4 | 3 | 17.9 | 54.8 |
| 5 | 4 | 19.9 | 52.6 |
| | | | Avg. = 56.2 |

From this Table and FIG. 3 it is evident that a simple series catholyte flow arrangement results in the first cell operating at an NaOH concentration well below the value corresponding to maximum power efficiency. For the 11234 configuration complex series catholyte flow arrangement, on the other hand, the first two cells are operating very close to the proper NaOH concentration.

Obviously a slightly different configuration might be found to be optimal for a different power efficiency curve but the principle will remain the same as long as the power efficiency curve exhibits a maximum within the region of catholyte caustic soda concentrations of interest.

What is claimed is:

1. In a process for producing chlorine and caustic soda in a bank of a plurality of electrolytic cells each having an anode compartment and a cathode compartment separated from each other by a cationic permeable membrane and wherein caustic soda catholyte produced in a first cathode compartment is passed serially to the cathode compartment of one or more succeeding cells, the improvement which comprises maintaining at least two of the initial cells in the bank in parallel catholyte flow by introducing water into the cathode compartment of each of said initial cells, withdrawing caustic soda catholyte from each of said initial cells, combining the catholyte streams so withdrawn and introducing said combined catholyte stream into the cathode compartment of one or more succeeding cells in the bank.

* * * * *